United States Patent [19]

Sparr, Sr.

[11] 4,023,602

[45] May 17, 1977

[54] POWDER DISPENSER

[76] Inventor: Anders V. Sparr, Sr., P.O. Box 48, Waupun, Wis. 53963

[22] Filed: Apr. 14, 1975

[21] Appl. No.: 568,126

[52] U.S. Cl. ..... 141/311 R; 222/181; 222/226

[51] Int. Cl.[2] ..... B65B 1/06

[58] Field of Search ..... 222/154, 199, 200, 425, 222/444, 447, 448, 449, 511, 515, 561, 226, 243, 247, 248, 181; 141/18, 320, 322, 319, 311

[56] References Cited

UNITED STATES PATENTS

| | | | |
|---|---|---|---|
| 533,560 | 2/1895 | Sanger | 222/248 X |
| 1,412,330 | 4/1922 | Altenberg | 222/511 X |
| 1,578,418 | 3/1926 | Gannon | 222/561 X |
| 2,339,644 | 1/1944 | Lucas | 222/425 |
| 2,389,683 | 11/1945 | Page | 141/320 |
| 2,626,084 | 1/1953 | Wekerle | 222/511 X |
| 2,666,555 | 1/1954 | Hill | 222/561 X |
| 2,723,783 | 11/1955 | Ewin | 222/425 X |
| 2,748,986 | 6/1956 | Steel | 222/200 X |

*Primary Examiner*—Robert B. Reeves
*Assistant Examiner*—Joseph J. Rolla
*Attorney, Agent, or Firm*—Clarence A. O'Brien; Harvey B. Jacobson

[57] ABSTRACT

A powder dispenser for enabling a measured quantity of chlorinated powder employed in the cleaning and sanitation of milk pipelines, bulk tanks and the like including a bulk container for the powder which maintains the powder in a dry condition, a combined control valve and agitator associated with the bottom of the container and a discharge member associated therewith and a detachable, transparent graduated container mounted therein in order to measure a precise quantity of powder for use depending upon the requirements of each individual installation.

3 Claims, 3 Drawing Figures

POWDER DISPENSER

BACKGROUND OF THE INVENTION

1. Field of the Invention

The present invention generally relates to a dispensing device for discharging and measuring a quantity of powdered cleaning material associated with dairy equipment such as milk bulk tanks, pipelines, transfer units and the like in which it is necessary to utilize a predetermined quantity of powder and a predetermined quantity of water to provide a cleaning solution having appropriate qualities that will effectively clean and sanitize the milk handling equipment.

2. Description of Prior Art

Devices for dispensing articles, liquids and powders are generally well known with such dispensers including reciprocal slide valves and the like for manually controlling the quantity of material dispensed. The following U.S. patents are exemplary of the development of the art in this field of endeavor.

U.S. Pat. No. 667,550 Feb. 5, 1901; U.S. Pat. No. 904,745 Nov. 24, 1908; U.S. Pat. No. 1,485,032 Feb. 26, 1924; U.S. Pat. No. 2,070,096 Feb. 9, 1937; U.S. Pat. No. 3,465,924 Sept. 9, 1969; U.S. Pat. No. 3,814,294 June 4, 1974.

SUMMARY OF THE INVENTION

An object of the present invention is to provide a powder dispenser in the form of a wall mounted container having a cylindrical discharge spout located centrally in the bottom thereof and provided with a manually actuated valve and agitator for dispensing chlorinated powder from the container.

Another object of the invention is to provide a dispenser in accordance with the preceding object together with a detachably mounted graduated container connected with the discharge spout to enable accurate measurement of the material being discharged.

A futher object of the invention is to provide a chlorinated powder dispenser for use in dispensing a desired quantity of powder for mixing with a predetermined quantity of water to provide a liquid cleaning and sanitizing solution having predetermined strength characteristics for sanitizing and cleaning milk handling equipment such as pipelines, transfer units, bulk tanks and the like so that such items will be maintained in substantially bacteria free condition.

Still another object of the invention is to provide a powder dispenser in accordance with the preceding object in which the container for the chlorinated powder is sealed in a manner to prevent moisture contact with the powder as well as metallic contact with the powder to avoid the corrosion effect of the powder and to maintain the powder in a condition so that it will readily flow.

Yet another important object of the invention is to provide a powder dispenser in accordance with the preceding objects which is quite simple in construction but yet effective for dispensing and agitating the powder and measuring the powder accurately so that it will provide the desired cleaning solution depending upon the installational requirements for each installation so that milk handling equipment will be maintained in a sanitary condition as required by various local ordinances.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of the powder dispenser of the present invention illustrating the manner in which it is supported on a vertical wall or the like.

DESCRIPTION OF THE PREFERRED EMBODIMENT

Figure 1:
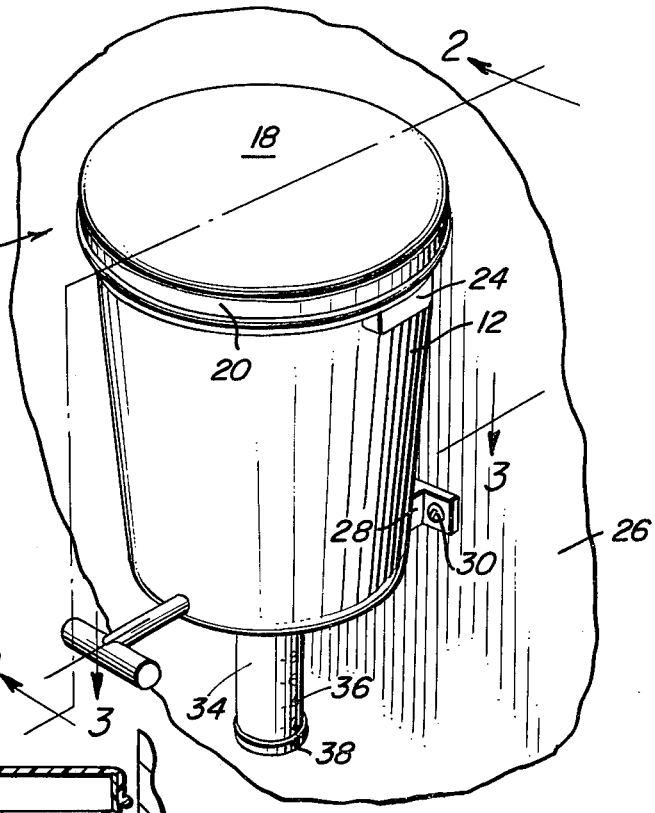
Figure 2:
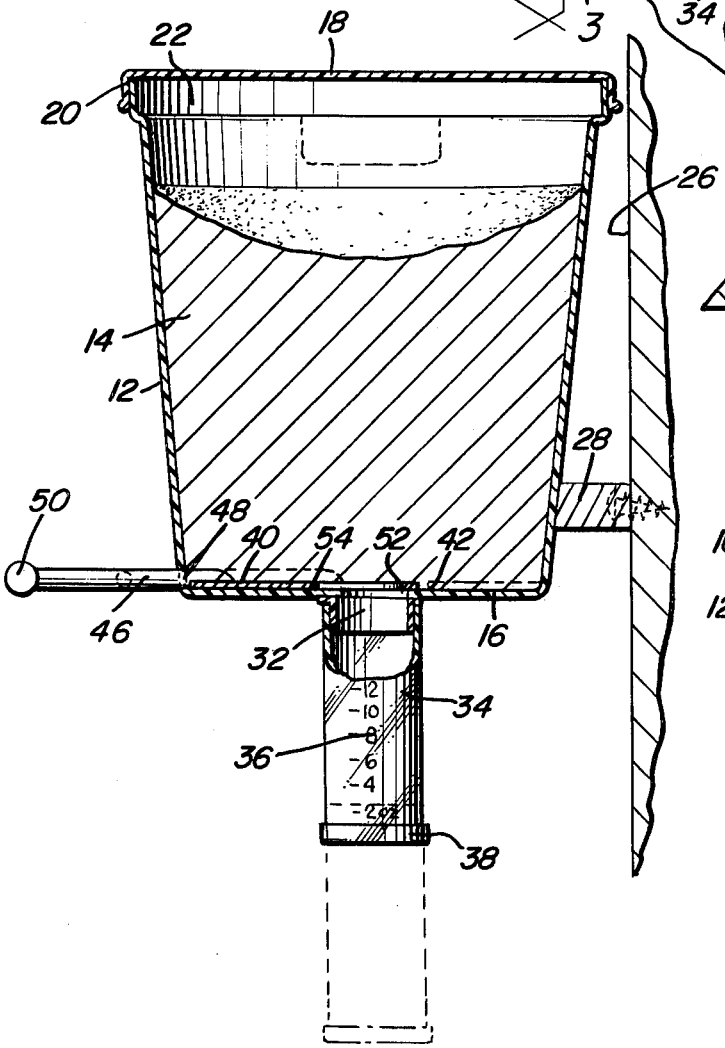
FIG. 2 is a vertical, sectional view taken substantially upon a plane passing along section line 2—2, on an enlarged scale, illustrating the structure of the dispenser and measuring container associated therewith.

Referring now specifically to the drawings, the powder dispenser of the present invention is generally designated by numeral 10 and includes an enlarged container 12 having a generally cylindrical configuration with the peripheral wall of the container tapering upwardly and outwardly slightly in order to receive a bulk quantity of chlorinated powder 14 such as that which is mixed with water to provide a cleaning solution for milk handling equipment such as pipelines, bulk tanks, transfer units and the like. The container 12 includes a substantially flat, circular bottom 16 and a closure lid 18 for the upper end thereof with the lid 18 including a depending rim 20 which telescopes over and sealingly engages the upper end flange 22 on the container 12 thus forming an airtight and moisture-tight seal between the closure lid 18 and the container 12 with the lid 18 being removable when desired in order to replenish the supply of chlorinated powder 14 within the container 12. To facilitate handling of the container, laterally projecting handles 24 may be provided thereon adjacent the flange 22 which is slightly outwardly offset in relation to the remainder of the container 12. The construction of the container 12 is preferably of plastic material so that the chlorinated powder 14 will not corrode the interior of the container 12 or the interior of the lid 18 which is also preferably of plastic material.

The container 12 is mounted from a vertical wall surface 26 by a suitable bracket structure 28 and fastening devices 30. Multiple brackets may be employed and, if desired, hook type brackets may be employed associated with the container so that the container may be lifted off of the supporting structures to facilitate removal of an empty container and replacement with a full container or permit removal of the empty container to a desired location for refilling with the chlorinated powder 14. The bracket 28 or plurality of brackets if used, will be integral with or otherwise connected to the container 12 and either be constructed of plastic or other inert material with the bracket, if constructed of metallic material, being isolated from the powder 14.

The center of the bottom 16 of the container 12 is provided with a depending cylindrical discharge spout 32 which has an external surface that tapers slightly inwardly and downwardly for frictionally and detachably mounting a measuring cup 34 which is of cylindrical construction and may be of transparent or translucent plastic material provided with graduations and indicia 36 thereon indicating the quantity of material in the measuring cup 34 when filled from the bottom 38 upwardly to a particular graduation. The graduations and indicia 36 indicate a desired number of ounces of dry powder so that the person using the dispenser may obtain therefrom a predetermined quantity of chlorinated powder for use in mixing with water to form a cleaning solution.

Figure 3:
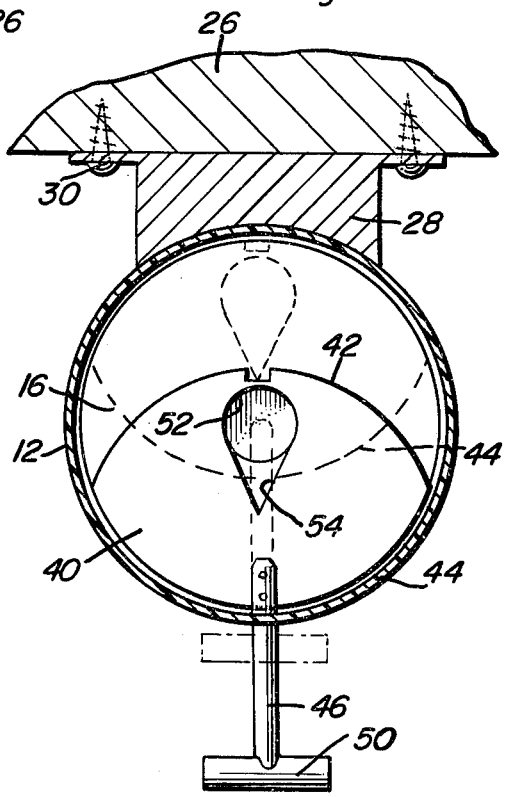
FIG. 3 is a transverse, vertical sectional view, on an enlarged scale, taken substantially upon a plane passing along section line 3—3 of FIG. 1 illustrating further structural details of the dispensing valve and agitator.

For controlling the dispensing of powder through the discharge spout or orifice 32, a substantially flat valve plate 40 is mounted interiorly of the container 12 with the plate 40 also being constructed of plastic material and having arcuate edges 42 and 44 respectively which conform with a portion of the interior of the bottom portion of the container 12 as illustrated in FIG. 3. Attached to the arcuate edge 44 of the plate 40 is a generally cylindrical and laterally extending handle 46 which extends out through a small opening 48 in the lower end of the peripheral wall of the container 12 with the opening 48 forming a snug fit with the handle 46. The outer end of the handle 46 is provided with a transverse handgrip 50 thus forming a T-handle for the valve plate 40 so that manual force may be exterted on the handle for moving the valve plate 40 from the open full line position illustrated in FIG. 3 to the closed broken line position illustrated in FIG. 3. The handle 46 and the transverse member 50 as well as the plate 40 are constructed of plastic material which is not affected by the corrosive character of the powder 14.

The valve plate 40 is provided with an opening 52 therein which generally conforms with the shape and size of the discharge spout 32 with the edge of the opening 52 oriented toward the arcuate edge 44 having a V-shaped extension 54 so that the discharge spout 32 will be gradually cut off and so that a relatively small discharge opening may be formed by moving the valve plate 40 partially toward the closed dotted line position. When the T-handle 50 is forced all the way in, the discharge spout 32 will be completely closed. As the valve plate 40 is moved toward the open position as the T-handle is moved outwardly, the V-shaped extension 54 will first become registered with the spout 32, so that the diverging edges thereof will provide a progressive increase in the rate of discharge of powder. Thus, by manipulating the T-handle 50, accurate control for the quantity of powder discharged into the measuring cup or container 34 may be obtained.

In view of the construction of the container 12 of plastic material and the fact that the plate 40 is not guided, the weight of the powder 14 retains the plate in a downwardly sealed relationship or frictional relationship with the bottom wall 16. However, by exerting downward force on the T-handle 50 or by twisting the T-handle 50 slightly, the powder may be agitated to assure flow through the discharge spout 32. Thus, the valve plate 40 not only serves as a control valve but also serves as an agitator in which the vertical, lateral or twisting movement of the valve plate will prevent the powder from bridging across the discharge spout and maintain the powder in a flowable condition.

The powder dispenser of the present invention is employed with a chlorinated powder used in cleaning dairy equipment. If such dairy equipment is not properly cleaned, high bacteria counts result which renders the milk unsafe for consumption. In order to properly clean the dairy equipment, the chlorinated powder is mixed with a predetermined quantity of water and circulated through the pipelines, bulk tank and the like. The cleaning powder is normally provided in a container which, after opening, exposes the powder to moisture which causes deterioration of the powder. In addition, it is difficult to accurately measure the quantity of powder obtained from an open top container. Moreover, depending upon the length and size of the pipelines, bulk tank and other equipment, the quantity of powder used with a predetermined quantity of water must be varied for each installation with the hardness of the water also determining the quantity of powder necessary.

The dispenser is mounted on the wall thus keeping the chemical material off the floor and at a convenient height. The closure lid and valve plate seal the powder to keep it dry and prevent caking and also prevents loss of chlorine thus keeping the powder at full efficiency. The container may conveniently be of five gallon capacity which will hold approximately 30 pounds of powder so that the supply of powder in the container will not have to be replenished too frequently. The graduated container or cup provides for exact measurement for the amount of powder needed in pipeline, bulk tank, transfer unit and the like with the graduated measurement enabling up to 16 ounces dry volume of powder to be measured. The external surface of the container provides a convenient surface on which a chart may be adhesively secured indicating water analysis and the requirements for cleaning and sanitizing the pipeline, bulk tank and parts of the system requiring handwashing and any other instructions relating to properly cleaning and sanitizing the milk handling equipment so that all milk contacting surfaces will be properly cleaned and sanitized to maintain bacteria count at a required minimum level.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A dispensing device for powder in which the powder will deteriorate and cake when exposed to moisture, said dispenser comprising a container having a removable closure lid and a discharge spout in the bottom thereof, said container including a flat bottom wall substantially larger than the discharge spout, said discharge spout being in the bottom wall and generally cylindrical in configuration and centrally located, a valve plate disposed against the upper surface of the bottom wall and forming a closure for the discharge spout, said valve plate having transverse dimensions smaller than the interior of the container for lateral movement in any direction along the upper surface of the bottom wall, handle means on said valve plate disposed exteriorly of the container for manually manipulating the valve plate for selectively opening and closing the spout, said valve plate being unrestricted and capable of movement in various directions within the container for agitating the powder therein to prevent bridging of the powder across the discharge spout thereby assuring discharge of powder, said valve plate including a single opening therein of a size similar to the discharge spout for selective alignment therewith, said opening in the valve plate being confined to an area remote from the handle means and including a tapering lateral extension extending toward the handle means to enable progressive increase or decrease in size of the portion of the opening in the valve plate which is in registry with the spout for controlling the discharge of powder from the container, said container being cylindrical, said valve plate having opposed arcuate surfaces conforming with the interior opposed arcuate surfaces of the container but having a transverse dimension substantially less than the bottom wall of the container to enable reciprocation of the valve plate with the powder always engaging the complete top surface of the valve plate serving to retain the valve plate downwardly in sealing relation to the bottom wall and to agitate powder engaged with the valve plate when it is moved.

2. The structure as defined in claim 1 wherein said handle means is in the form of a rod having its inner end attached to the upper surface of the valve plate and a handgrip on the outer end with the rod extending through a closely fitting hole in the periphery of the container to enable reciprocation of the valve plate as well as lateral and vertical movement thereof for agitating the powder, said container, spout, valve plate, handle means, bottom wall and the lid being constructed of plastic material to eliminate corrosive effects of the powder on the container and associated structure, said container and spout being of one-piece construction, and a transparent measuring cup mounted on said discharge spout, said measuring cup including a graduated scale thereon indicating the quantity of powder dispensed into the cup, said cup being an elongated cylindrical member having an open upper end and a closed lower end with the spout and cup having coacting tapering surfaces for frictionally locking the cup in position on the spout and enabling removal thereof so that the powder dispensed into the cup may be discharged therefrom; said cup being constructed of plastic material and having sufficient transparency to enable the level of powder in the cup to be observed and compared with the graduated scale on the cup, said lid and cup serving to exclude moisture from the powder in the container by sealing engagement therewith.

3. In a combined storage and dispensing apparatus for chlorinated powder employed powder employed in cleaning and sanitizing milk handling equipment in which the powder is subject to deterioration and caking when subjected to moist atmospheric conditions, said apparatus including a container defined by a peripheral wall, a substantially flat bottom wall and a removable lid sealingly engaged with the upper end of the peripheral wall and adapted to receive a quantity of powder and be supported in a vertical orientation with the bottom wall in a generally horizontal position, a tubular discharge spout depending from the central portion of the bottom wall and communicating with the interior of the container for discharging powder therefrom, a tubular closure member engaged with the spout to form a closure therefor, said tubular member and spout including coacting means removably supporting the closure member from the spout, said closure member being substantially longer than the spout, being transparent and provided with a graduated scale thereon in order to enable observation of the quantity of powder in the closure member thereby providing a measuring cup by which the quantity of powder discharged from the spout and positioned in the closure member can be determined and providing means by which the powder may be conveyed to a container in which the powder is to be mixed with water to form an aqueous cleaning and sanitizing solution, a combined valve plate and powder agitator disposed in the container and provided with a flat bottom surface engaged with the flat upper surface of the bottom wall and forming a closure for the spout when an imperforate portion of the plate is aligned with the spout, the upper surface of the valve plate being, at all times, engaged by the powder whereby movement of the valve plate will agitate the powder engaged therewith, said valve plate including a peripheral dimension less than the interior dimension of the container to enable movement of the valve plate in relation to the bottom wall of the container, handle means connected to the upper surface of the valve plate and extending laterally outwardly through a close fitting opening in the peripheral wall adjacent the bottom wall to enable horizontal movement of the valve plate in any direction and movement of the valve plate away from the bottom wall in an upwardly swinging manner for loosening and agitating any caked powder in the container adjacent the valve plate, said valve plate having an opening therein generally the same size as the discharge spout for selective alignment therewith, said opening including a tapering lateral extension in the direction of horizontal movement of the valve plate between its closed and open position to progressively increase and decrease the flow of powder from the discharge spout, all of the components of the apparatus being constructed of plastic material to minimize deterioration by contact with the powder.

* * * * *